United States Patent [19]

Kawai et al.

[11] Patent Number: 4,639,676

[45] Date of Patent: Jan. 27, 1987

[54] DEVICE FOR DIAGNOSIS OF TROUBLE IN VEHICLE IGNITION DEVICES

[75] Inventors: Akio Kawai, Yokohama; Ken Ito; Hideo Iwamoto, both of Yokosuka, all of Japan

[73] Assignee: Nissan Motor Co., Ltd., Yokohama, Japan

[21] Appl. No.: 662,028

[22] Filed: Oct. 18, 1984

[30] Foreign Application Priority Data

Oct. 19, 1983 [JP] Japan ..... 58-194204

[51] Int. Cl.[4] ..... F02P 17/00

[52] U.S. Cl. ..... 324/380

[58] Field of Search ..... 324/380, 381, 382, 378

[56] References Cited

U.S. PATENT DOCUMENTS 4,101,822 7/1978 Doss et al. ..... 324/381

4,449,100 5/1984 Johnson et al. ..... 324/380

*Primary Examiner*—Stanley T. Krawczewicz

*Attorney, Agent, or Firm*—Schwartz, Jeffery, Schwaab, Mack, Blumenthal & Evans

[57] ABSTRACT

The diagnostic device comprises voltage divider resistors, two comparators, a start switch, a microcomputer, two transistors, and two light emitting diodes. The ignition signal is voltage-divided by the voltage divider resistors, and the result of this voltage division is input into the positive terminals of the comparators. Reference voltages are input to the negative terminals of the comparators which determine how high the inputs to the positive terminals must be for each comparator to have an "H" level output. When the start switch is turned ON the device starts to operate. In the microcomputer, which has a timer function built in, the interrupt terminal (INT) becomes connected to the output terminal of the comparator; the reset terminal (RES) becomes connected to the start switch. In addition, when the result of the diagnosis is normal, the output terminal OUT 1 of the microcomputer connected to the base of the transistor outputs a signal, while when the result of the diagnosis is abnormal, the output terminal OUT 2 connected to the base of the transistor outputs a signal. A light emitting diode of one color, for example green, is connected to the collector of the transistor, and lights up when the result of the diagnosis is normal, while a light emitting diode of another color, for example red, is connected to the collector of the other transistor, and lights up when the result of the diagnosis is abnormal.

8 Claims, 10 Drawing Figures

DEVICE FOR DIAGNOSIS OF TROUBLE IN VEHICLE IGNITION DEVICES

BACKGROUND OF THE INVENTION

1. Field of the Invention

This invention relates to a device for diagnosing trouble in ignition devices which have a longer electrical discharge time than ordinary ignition devices.

2. Description of the Prior Art

In recent years, ignition devices with long electrical discharge times, such as the device shown in FIG. 1, have been used with the aim of improving fuel efficiency and acceleration in vehicles.

In FIG. 1, an ignition coil 1 and a transistor 2 which is used for driving the spark coil are the same as in an ordinary ignition device. The control circuit 3, which comprises an oscillator and a monostable multivibrator, is connected so that it receives the signal A, which has the voltage waveform shown in FIG. 2*a* and is generated from the ignition signal at the primary side of the ignition coil 1, as input, and outputs the square wave signal B shown in FIG. 2*b*. A transformer 4, which includes a forward resonant-type DC/DC converter and a high-voltage diode used for half-wave rectification, is driven by a power transistor 5 driven by the output of the above-mentioned control circuit 3. In a previously existing type of ignition system, it is possible to lengthen the electrical discharge time by adding the above-mentioned control circuit 3, transformer 4 and power transistor 5, so that the signal C which is generated on the secondary side of the ignition coil 1, that is to say the secondary current of the ignition coil, becomes as is shown by the solid line in FIG. 2*c*. The dotted line in FIG. 2*c* shows the secondary current waveform without the added components.

However, when the electrical discharge time of the ignition device is lengthened as described above, even if trouble develops in the control circuit 3, transformer 4 or power transistor 5, so that the lengthening of the electrical discharge time is not performed (such a discharge is to be referred to below as a discharge), a prior art ignition system will continue to ignite and the engine will continue to run, so that it is difficult to detect the trouble.

SUMMARY OF THE INVENTION

The object of the present invention is to provide a diagnostic device which easily checks for the presence or absence of trouble in a long electrical discharge ignition device.

Another object of the present invention is to provide a diagnostic device which can shorten the time required for inspection and maintenance of a long-period electrical discharge device.

Another object of the present invention is to provide a diagnostic device which can accurately detect whether or not the electrical discharge in a long-period electrical discharge ignition device is occuring normally.

Another object of the present invention is to obviate the above-mentioned problems with previously existing devices.

Briefly described, these and other objectives of the present invention are accomplished by the provision of an improved diagnostic device for ignition devices which comprises a measurement section which measures the voltage level condition of the voltage waveform on the primary side of the ignition coil arising from the ignition signal, a judgment section which judges whether or not the voltage level exceeds a certain specified value after a certain specified time has elapsed from the time the ignition signal is generated, and an indicator section which indicates the result of that judgment.

BRIEF DESCRIPTION OF THE DRAWINGS

These and other objectives, features and advantages of the present invention will be more apparent from the following description of a preferred embodiment, taken in conjunction with the accompanying drawings, in which.

DESCRIPTION OF THE PREFERRED EMBODIMENTS

Figure 3:
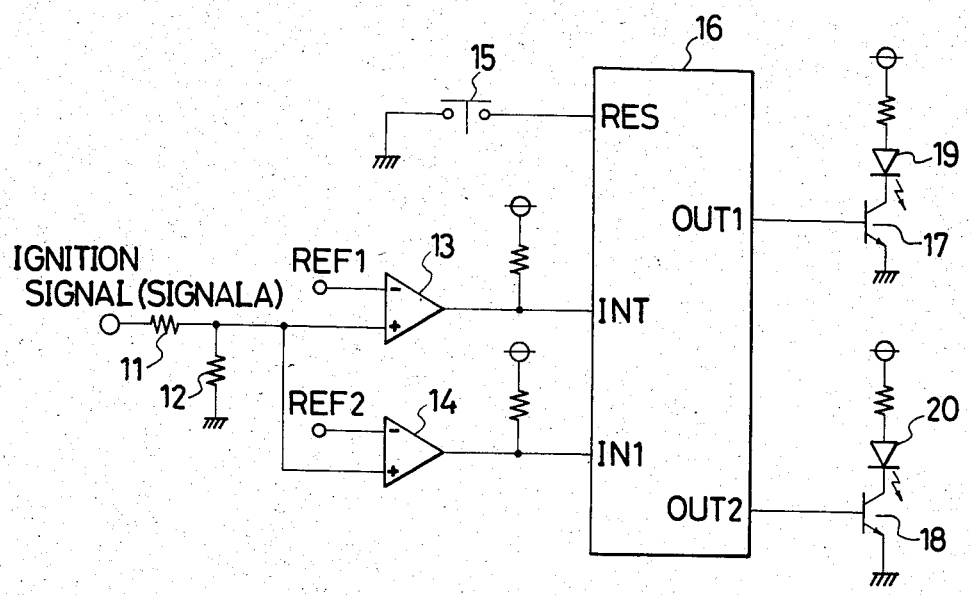
FIG. 3 is an overall circuit diagram of a diagnostic device which embodies the present invention.

A diagnostic device which embodies the present invention is shown in FIG. 3. This diagnostic device comprises voltage divider resistors 11 and 12, comparators 13 and 14, a start switch 15, a microcomputer 16, transistors 17 and 18, and light emitting diodes 19 and 20.

Figure 1:
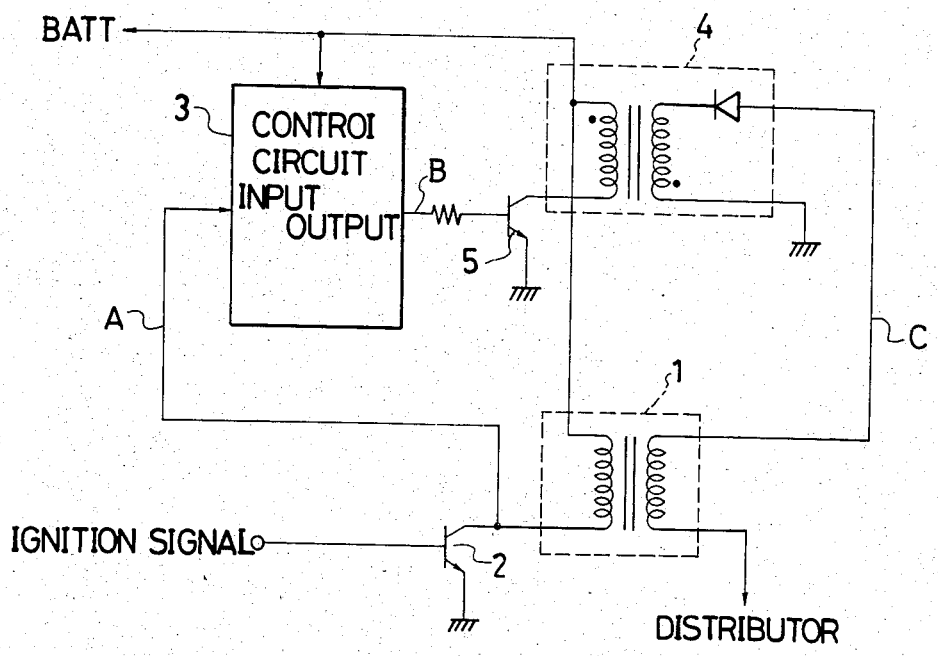
FIG. 1 is an overall circuit diagram of a long electrical discharge ignition device.
Figure 2A:
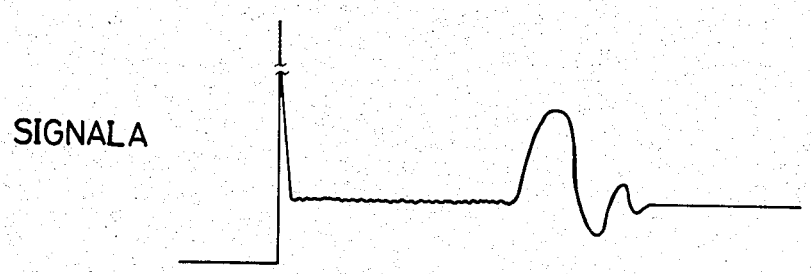
FIG. 2*a* through 2*c* is a waveform diagram which shows the signal waveforms in each of the lines in the long electrical discharge ignition device shown in FIG. 1.
Figure 2B:
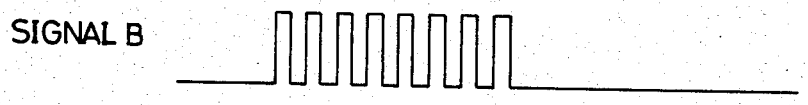
Figure 2C:
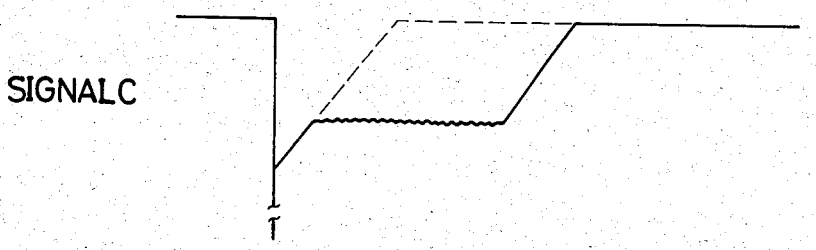

In this figure, the signal A which is generated in the input line of the control circuit 3 in FIG. 1 as a consequence of the ignition signal is voltage-divided by the voltage divider resistors 11 and 12, and the result of this voltage division is input into the positive terminals of the comparators 13 and 14. Reference voltages are input to the negative terminals of the comparators 13 and 14 which determine how high the inputs to the positive terminals must be for each comparator to have an "H" level output. For example the reference voltage (REF 1) applied to the negative terminal of the comparator 13 might be set so that an input of 100 V or more to the positive terminal is required to give an "H" level output, while the reference voltage (REF 2) applied to the negative terminal of the comparator 14 is set so that an input of 40 V or more to the positive terminal is required to give an "H" level output. When the start switch 15 is turned ON the device starts to operate. In the microcomputer 16, which has a timer function built in, the interrupt terminal (INT) becomes connected to the output terminal of the comparator 13; the reset terminal (RES) becomes connected to the start switch 15. In addition, when the result of the diagnosis is normal, the output terminal OUT 1 connected to the base of the transistor 17 outputs a signal, while when the result of the diagnosis is abnormal, the output terminal OUT 2 connected to the base of the transistor 18 outputs a signal. A light emitting diode 19 of one color, for example green, is connected to the collector of the transistor 17, and lights up when the result of the diagnosis is normal, while a light emitting diode 20 of another color, for example red, is connected to the collector of the transistor 18, and lights up when the result of the diagnosis is abnormal.

Next, the operation of this device will be explained.

Figure 4A:
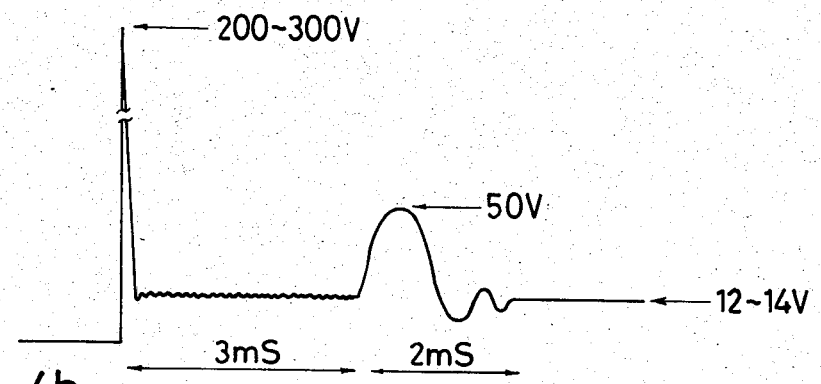
FIGS. 4*a* and 4*b* show the voltage waveforms on the primary side in the ignition device.
Figure 4B:
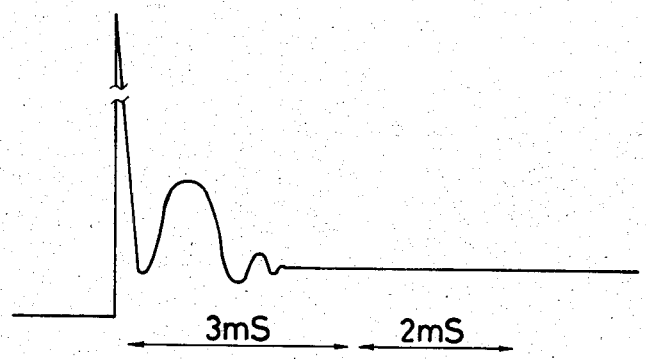
Figure 5A:
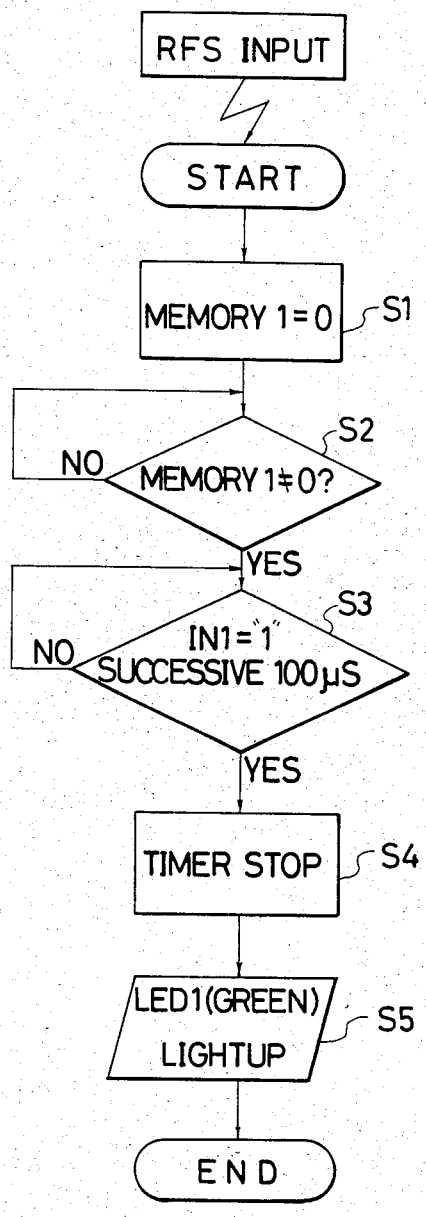
FIGS. 5*a* through 5*c* show a flow chart of the control program for the diagnostic device shown in FIG. 3.
Figure 5B:
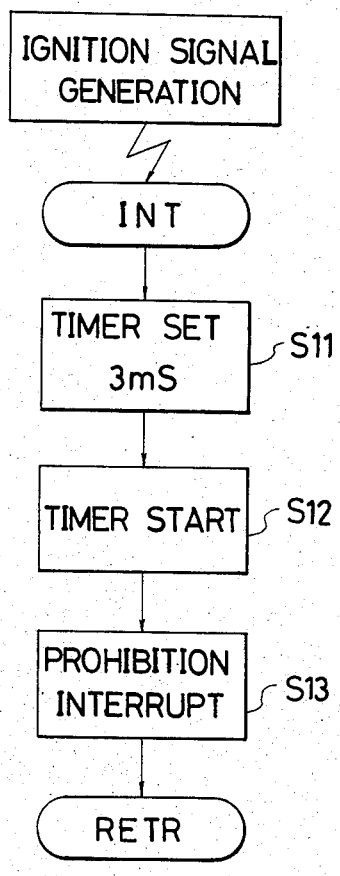

In this particular embodiment, the judgment or determination of normal or abnormal is based on the voltage waveform while the engine is idling. In this case, when the operation is normal, the voltage waveforms are as shown in FIG. 4*a;* when operation is abnormal, the voltage waveforms are as shown in FIG. 4*b*. A flow chart of the control program that is used is shown in FIG. 5.

When an inspector turns the start switch ON, a reset signal is applied to the microcomputer 16. Then the main program shown in FIG. 5*a* starts to run. In step (S1), "0" is written in to an area of memory that has been set asids as a temporary memory area in an RAM that is not shown in the circuit diagram. The system goes on standly until this "0" is replaced by "1". Then, when an ignition signal is applied, an input of 100 V on more enters the positive terminal of the comparator 13 and an "H" level output is input to the INT terminal of the microcomputer 16, so that an interrupt occurs, causing the interrupt program shown in FIG. 5*b* to be executed. In this flow, first the timer that is built into the microcomputer 16 is set so that an overflow occurs 3 ms later (S11), and then the timer is started (S12). Since the judgment of normal or abnormal is made only once, once the interrupt program is started, further interrupts are prohibited; a mask is applied with respect to additional interrupt inputs from outside.

Figure 5C:
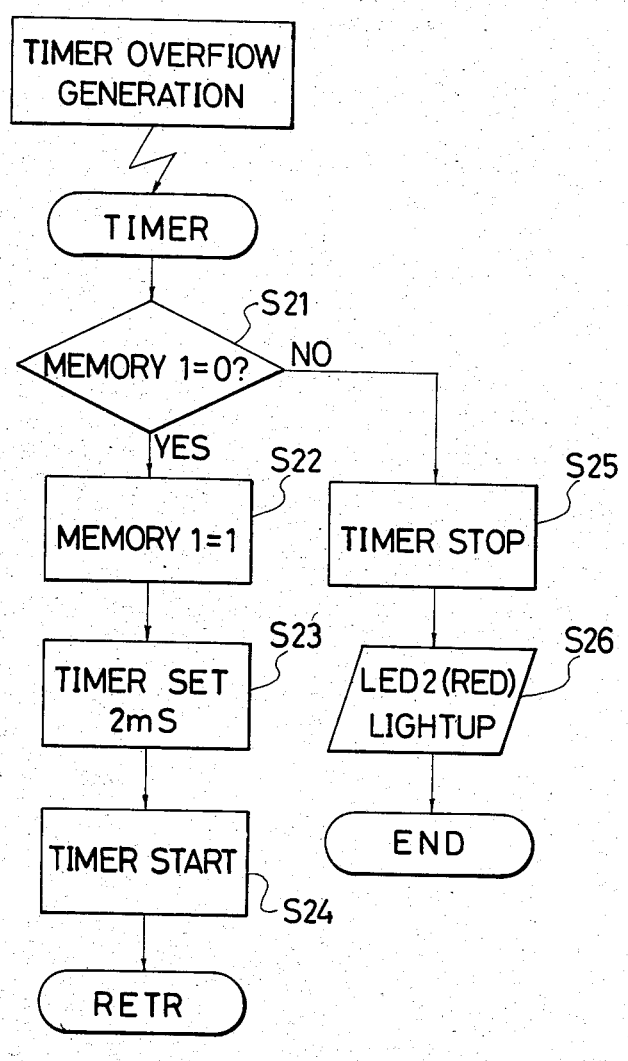

Then, after 3 ms has elapsed the timer overflows, causing the timer overflow program shown in FIG. 5*c* to be executed. Here, first a judgment is made as to whether or not the number in memory is "0" (S21); if it is 0 (judgment of YES) then the "0" is replaced by "1" in memory (S22). Then the timer is set so that it will overflow against after another 2 ms, and the timer is started (S23, S24).

Since "1" is written into the memory when this timer overflow program is executed, the main program is released from standly mode and a judgment is made as to whether or not an "H" level signal, in other words a "1", is being input to the terminal IN1 (S3). Here, if the ignition device is operating normally, as shown in FIG. 4*a,* within 2 ms a peak occurs in which the voltage remains at about 50 V for a continuous period of 100 μs or more, and the output of the comparator 14 becomes "H", so that the result of the judgment is YES and the timer is stopped (S4). Next, overflows are prohibited, and then, in order to cause the green light emitting diode 19 to light up to show that the voltage waveform has been judged to be normal, output is produced at the terminal OUT 1, causing the transistor 17 to become conducting, and the current through the transistor 17 lights up the light emitting diode 19 (S5).

Meanwhile, if the operation of the ignition device is abnormal, 2 ms elapses without a judgment of YES occurring in step (S3) of the main program, so that a second timer overflow occurs and the timer overflow program starts to run for the second time. This time, since "1" has already been written in to the memory 1, a judgment of NO is made in step (S21) and the timer stops output is produced at the terminal OUT 2, causing the transistor 18 to become conducting and the red light emitting diode, which indicates an abnormal judgment, to light up (S25, S26).

When the diagnosis is done this way, it is easy to check whether or not the electrical discharge is occurring normally, preventing faulty engines from getting through the final factory inspection and dealer maintenance checkups. Moreover, further inspections and maintenance can be performed accurately and in a short time.

In this embodiment, when the judgment is made on the input to IN 1 of the microcomputer 16 the condition "for a continuous period of 100 μs" is put in to prevent erroneous judgments due to noise. In addition, the check time for the electrical discharge is set at 3 ms (idling time), but thus can be set to another value to match different driving conditions.

In summary, since the present invention permits a judgment to be made as to whether or not the discharge is occurring normally based on differences in the voltage waveform at the primary side of the ignition coil that results from the ignition signal, and indicates the result of this judgment, it is very easy to diagnose a long electrical discharge ignition device to determine whether or not it is operating normally and thus prevent failures to detect abnormal operation during inspections and maintenance with a high degree of certainty. This shortens the time needed for such inspections and maintenance, which offers great practical value.

Various modifications will become possible for skilled technicians after learning the details of the present invention without departing from the scope thereof.

What is claimed is:

1. In a vehicle ignition device which is constructed to lengthen an electrical discharge time of an ignition coil, a diagnostic device for diagnosing whether or not the longer electrical discharge is occurring normally, comprising:

measuring means connected to a primary side of the ignition coil for measuring a level condition of a voltage on the primary side of the ignition coil;

means connected to said measuring means for determining whether or not the voltage level measured by said measuring means exceeds a predetermined value, said determining means operable only after a predetermined time is elapsed from the time the ignition signal is generated, said determining means including timer means for measuring said predetermined time; and indicating means for indicating the result of the determination which is performed by said determination means.

2. A diagnostic device in a vehicle ignition device as claimed in claim 1, in which said measuring means (13,14) comprises a first and a second comparators (13,14) for comparing the voltage level on the primary side of the ignition coil (1) with a first and second reference voltage levels, respectively and delivering signals in dependence upon the results of the comparisons.

3. A diagnostic device in a vehicle ignition device as claimed in claim 2, in which said determining means (16) comprises a microcomputer (16) connected to the first and second comparators (13,14) for delivering a first signal when the voltage level on the primary side of the ignition coil (1) is higher than a predetermined value after said predetermined time is elapsed from the time the ignition signal is generated and a second signal when the voltage level on the primary side of the ignition coil is lower than said predetermined valve after said predetermined time is elapsed from the time the ignition signal is generated.

4. A diagnostic device in a vehicle ignition device as claimed in claim 3, in which said indicating means (19,20) comprises a first and a second light emitting diodes (19,20) connected to the microcomputer (16).

5. A diagnostic device in a vehicle ignition device as claimed in claim 4, in which the first light emitting diode (19) emits one color light according to the first signal from the microcomputer (16) and the second light emitting diode (20) emits another color light according to the second signal from the microcomputer (16).

6. A diagnostic device in a vehicle ignition device as claimed in claim 2, in which said measuring means further comprises voltage divider resistors (11,12).

7. A diagnostic device in a vehicle ignition device as claimed in claim 1, wherein said timer means further measures a predetermined time interval after said predetermined time and wherein said determining means is operable only during said predetermined time interval for determining whether or not said voltage level exceeds said predetermined value.

8. A dianostic device in a vehicle ignition device as claimed in claim 7, wherein said determining means is operable during said predetermined time interval for determining whether or not said voltage level continuously exceeds said predetermined value.

* * * * *